US005561347A

United States Patent [19]

Nakamura et al.

[11] Patent Number: 5,561,347

[45] **Date of Patent: *Oct. 1, 1996**

[54] PHOTOMULTIPLIER

[75] Inventors: Kimitsugu Nakamura; Hiroyuki Hanai; Takeo Hashimoto; Shinji Suzuki; Yasushi Watase; Masumi Tachino, all of Hamamatsu, Japan

[73] Assignee: Hamamatsu Photonics K.K., Hamamatsu, Japan

[ * ] Notice: The term of this patent shall not extend beyond the expiration date of Pat. No. 5,420,476.

[21] Appl. No.: 318,291

[22] Filed: Oct. 5, 1994

Related U.S. Application Data

[63] Continuation of Ser. No. 68,220, May 27, 1993, Pat. No. 5,420,476.

[30] Foreign Application Priority Data

Dec. 9, 1993 [JP] Japan ..... 5-309371

[51] Int. Cl.[6] ..... H01J 43/04; H01J 43/18; H01J 43/20; H01J 40/00

[52] U.S. Cl. ..... 313/532; 313/533; 313/534; 313/537; 313/541; 313/542

[58] Field of Search ..... 313/532, 533, 313/534, 537, 541, 103 R, 105 R, 530, 544, 542, 417; 250/214 VT, 207

[56] References Cited

U.S. PATENT DOCUMENTS

| | | | |
|---|---|---|---|
| 3,873,867 | 3/1975 | Girvin . | |
| 4,099,079 | 7/1978 | Knapp | 313/103 |
| 5,150,002 | 9/1992 | Van der Hoeck | 313/417 |
| 5,420,476 | 5/1995 | Nakamura | 313/537 |

FOREIGN PATENT DOCUMENTS

| | | |
|---|---|---|
| 0573194 | 12/1993 | European Pat. Off. . |
| 5214585 | 4/1977 | Japan . |
| 5318864 | 6/1978 | Japan . |
| 4292843 | 10/1992 | Japan . |

OTHER PUBLICATIONS

European Search Report dated Jul. 5, 1995.

Patent Abstracts of Japan, vol. 017, No. 104 (E–1328), 3 Mar. 1993, JP A 04 292843 (Hamamatsu Photonics KK) 16 Oct. 1992, abstract.

*Primary Examiner*—Sandra L. O'Shea
*Assistant Examiner*—John Ning
*Attorney, Agent, or Firm*—Cushman Darby & Cushman, L.L.P.

[57] ABSTRACT

There is provided a photomultiplier in which a transmittance of an incident light and a photosensitivity is high and a hysteresis characteristic is excellent. Therefore, in the present invention, a photocathode 16, dynodes 17*a* to 17*c* and an anode 18 are supported between insulating material substrates 12*a* and 12*b* provided in a glass bulb 11. A transparent conductive film 19 is formed on an inside wall surface of a light entrance portion 15. The transparent conductive film 19 electrically contacts with a pad 20 which is led through a terminal 14 to the outside. The same potential as the photocathode 12 is applied through the pad 20 to the transparent conductive film 19. The incident light directly impinges on the photocathode 16 through the glass bulb 11 and the transparent conductive film 19 at a place corresponding to the light entrance portion 15. As a result, the incident light reaches the photocathode 12 with not being interfered at all, and the transmittance of the incident light is improved. Since a predetermined potential is applied to the transparent conductive film 19, the change of the potential of the inside wall surface of the glass bulb 11 is performed at high speed, and the hysteresis becomes extremely small.

11 Claims, 9 Drawing Sheets

PHOTOMULTIPLIER

This application is a continuation of U.S. patent application Ser. No. 08/068,220, filed May 29, 1993, now U.S. Patent No. 5,420,476.

BACKGROUND OF THE INVENTION

1. Field of the Invention

The present invention relates to a photomultiplier of so-called side-on type into which light to be measured is incident through a side of a container.

2. Related Background Art

FIG. 1 is a side view, partly in vertical section, of a conventional side-on type photomultiplier which is generally used, and FIG. 2 is a cross-sectional view of the photomultiplier. In this photomultiplier, light to be measured enters through a side of a glass bulb 1 which is a transparent closed container. The incident light passing through the glass bulb 1 impinges on a photosurface of a reflection type photocathode 2, whereby photoelectrons are emitted from the photosurface. The photoelectrons are then delivered to an electron multiplying unit constituted of plural stages of dynodes 3*a*, 3*b*, 3*c* . . . . The electron multiplying unit successively multiplies the photoelectrons, and the multiplied electrons are collected as an output signal in an anode 4.

A grid electrode 6 is provided between a light entrance portion 5 of the glass bulb 1 and the photocathode 2 so as to guide the photoelectrons emitted from the photocathode 2 to dynode 3*a* of the first stage. The potential of the grid electrode 6 is set to be equal to that of the photocathode 2. There are various types of grid electrodes which may be employed as the grid electrode 6. For example, the grid electrode 6 may be a grid electrode (not shown) constituted in a manner that fine conductive wires are placed in a grid-shaped configuration, or a grid electrode constituted in a manner that one fine conductive wire 6*c* is helically wound around two supporting rods 6*a* and 6*b* as shown in FIG. 1.

There is also known a side-on type photomultiplier disclosed in JP-B-53-18864. As shown in FIG. 3, in this side-on type photomultiplier, a glass plate 7 on which a transparent conductive film is formed is employed instead of the grid electrode 6.

There is also known a side-on type photomultiplier disclosed in JP-A-4-292843. JP-A-4-292843 discloses a structure in which a conductive portion such as an aluminum-evaporated film is formed on an inside wall surface of a glass bulb except for a light entrance portion. Further, JP-A-4-292843 also discloses that the conductive portion is formed also on the light entrance portion when the conductive portion is transparent. The conductive portion reduces a resistance of the inside wall surface of the glass bulb, so that a time constant formed by stray capacitance and the surface resistance of the inside wall surface of the glass bulb is small. Since the time constant is small, the unstableness of the potential on the inside wall surface of the glass bulb is eliminated. As a result, an influence upon an electron track of photoelectrons is reduced, whereby a hysteresis characteristic is improved. The hysteresis is a phenomenon that an output signal rises not suddenly but gradually to reach stability when an optical pulse enters a photomultiplier.

SUMMARY OF THE INVENTION

According to the present invention, there is provided a photomultiplier comprising: a transparent closed container including a light entrance portion; a reflection type photocathode, provided in the closed container, for emitting photoelectrons in response to an incident light transmitted through the light entrance portion; a transparent conductive film formed on an inside wall surface of the light entrance portion of the closed container, a predetermined potential being applied to the film; an electron multiplying unit, including plural stages of dynodes, for electron-multiplying the photoelectrons emitted from the reflection type photocathode; and an anode for collecting the multiplied electrons.

The transparent conductive film may be formed on the entire inside wall surface of the closed container.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 4:
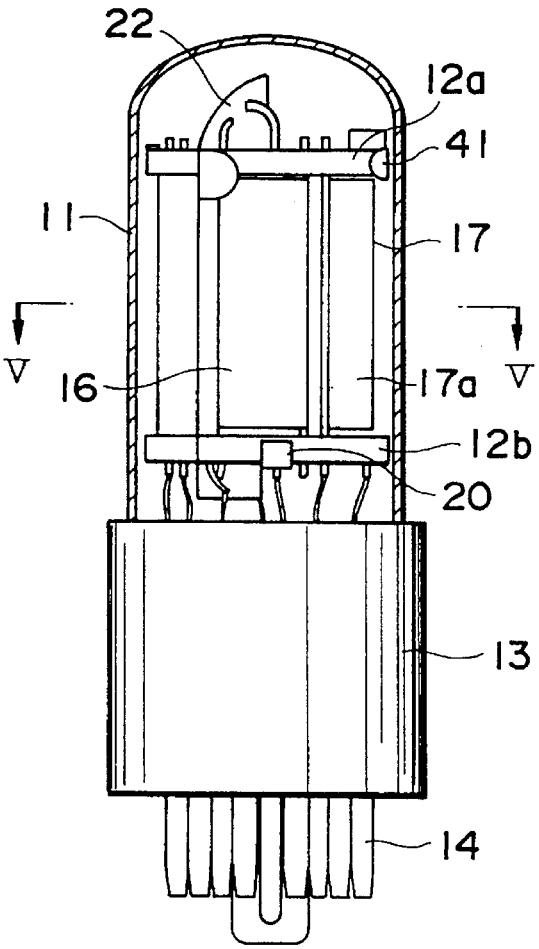
FIG. 4 is a side view, partly in vertical section, of a photomultiplier according to a first embodiment of the present invention.
Figure 5:
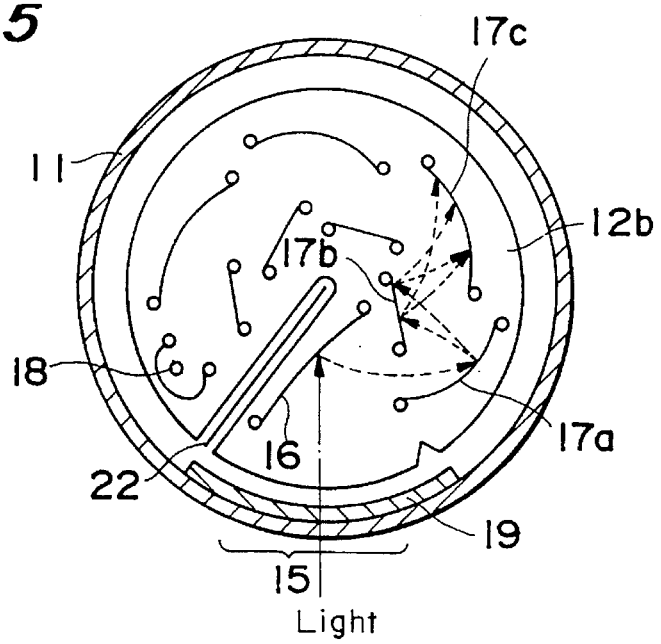
FIG. 5 is a cross-sectional view of the photomultiplier according to the first embodiment.

FIGS. 4 and 5 show a photomultiplier of so-called side-on type to which an embodiment of the present invention is applied. A glass bulb 11 is a transparent closed container. Specifically, the glass bulb 11 is a transparent cylinder closed at the upper and lower ends. Insulating material substrates 12*a* and 12*b* are provided at the upper and lower positions in the glass bulb 11, respectively. The substrates 12*a* and 12*b* support various electrodes. The various electrodes are led to the outside through terminals 14 provided on a base 13 placed at the bottom of the glass bulb 11. A photocathode 16, an electron multiplying unit 17 and an anode 18 for collecting an output signal are supported between the insulating material substrates 12*a* and 12*b*. The photocathode 16 is placed so as to be inclined at a predetermined angle to a light entrance portion 15 of the glass bulb 11. The electron multiplying unit 17 is constituted of plural stages of dynodes 17*a*, 17*b*, 17*c* . . . for successively multiplying photoelectrons emitted from the photocathode 16.

A transparent conductive film 19 is partically formed on an inside wall surface of the light entrance portion 15 of the glass bulb 11. Although the transparent conductive film 19 may be formed in various manners, the film 19 is preferably formed in a manner that chromium (Cr) is selectively evaporated onto the inside wall surface of the glass bulb 11. The transparent conductive film 19 electrically contacts with a pad 20 adhered to the inside wall surface of the light entrance portion 15 of the glass bulb 11. The pad 20 is led through the terminal 14 to the outside.

Figure 1:
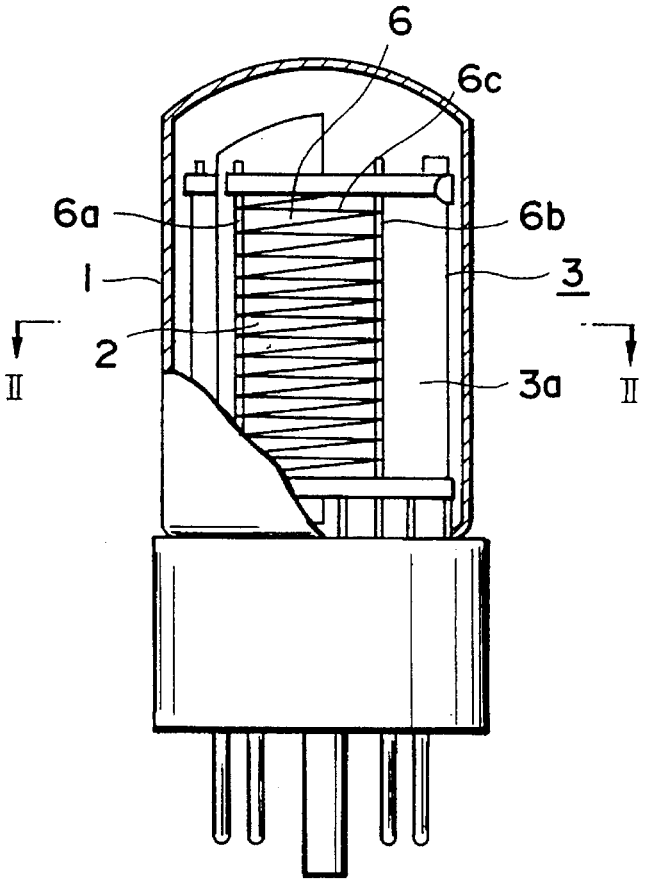
FIG. 1 is a side view, partly in vertical section, of a conventional photomultiplier which is generally used.
Figure 2:
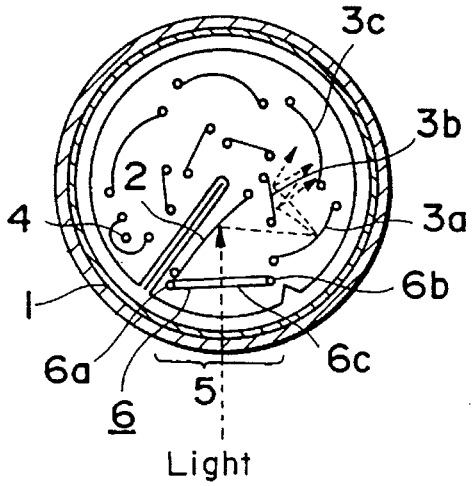
FIG. 2 is a cross-sectional view of the conventional photomultiplier which is generally used.
Figure 3:
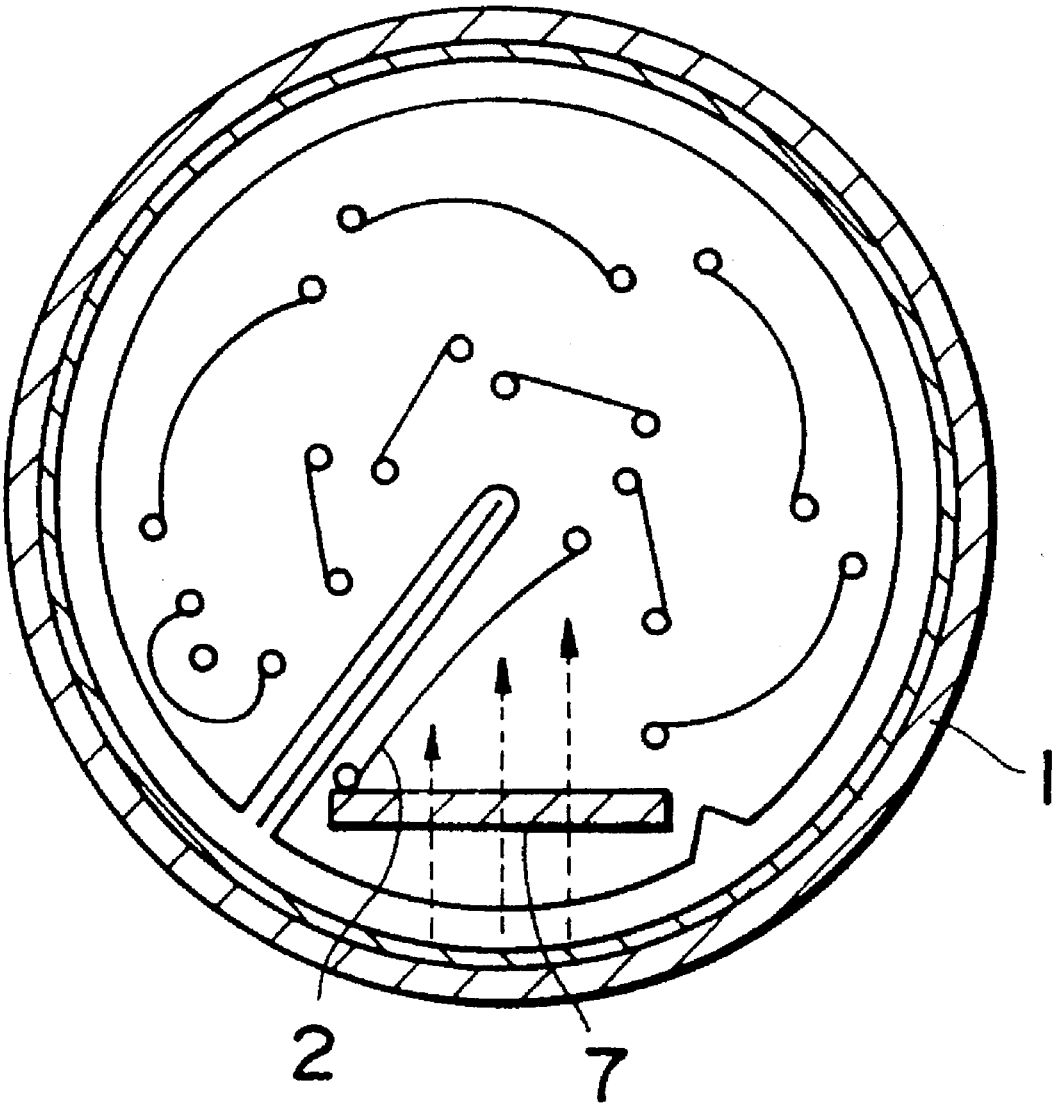
FIG. 3 is a cross-sectional view showing an example of another conventional photomultiplier.

In this arrangement, predetermined potentials are applied to the photocathode 16 and the anode 18 through the terminals 14, respectively. For example, a potential of −1 KV is applied to the photocathode 16, and a ground potential is applied to the anode 18. An appropriate potential which divides a voltage between the photocathode 16 and the anode 18 is applied through the terminal 14 to each of the plural stages of dynodes 17*a*, 17*b*, 17*c* . . . . For example, the same potential as the photocathode 16, that is, the potential of −1 KV is applied to the transparent conductive film 19 through the terminal 14 and the pad 20. In such a state, incident light directly impinges on the photocathode 16 through the light entrance portion 15 of the glass bulb 11 and the transparent conductive film 19. At this time, there is no grid electrode between the light entrance portion 15 and the photocathode 16 like the prior art, and therefore the incident light reaches the photocathode 16 with not being interfered at all. That is, in the conventional photomultiplier as shown in FIGS. 1 and 2, since the grid electrode 6 is placed in front of the photocathode 2, a part of the light which is to be entered into the photocathode 2 through the glass bulb 1 is scattered or absorbed by the conductive wire 6*c* of the grid electrode 6. Therefore, even if the incident light is uniform, a part of the incident light does not reach the photocathode 2. Further, loss is caused due to absorption or scattering when light passes through a glass material. Therefore, when the glass plate 7 is placed in the glass bulb 1 like the conventional photomultiplier as shown in FIG. 3, there arises a problem that the loss becomes twofold since the light passes through a glass material two times. However, in the present embodiment, as described above, the incident light reaches the photocathode 16 with not being interfered at all.

Further, if the transparent conductive film 19 is a chromium-evaporated film, the loss of light caused when the incident light passes through the transparent conductive film 19 is extremely small since the transparent conductive film 19 has a high transmittance of 98%. In contrast, in the conventional photomultiplier as shown in FIGS. 1 and 2, since a grid electrode having a transmittance of 75% is generally employed as the grid electrode 6, 25% of the incident light does not reach the photocathode 2. Therefore, the transmittance for the incident light entering the photomultiplier according to the present invention is extremely improved.

Furthermore, in the conventional photomultiplier as shown in FIG. 3, there also arises a problem associated with manufacture. That is, conventionally, in a manufacturing process of the photocathode 2, an alkali metal used for producing a photosurface flows and reaches the photosurface as shown by the dotted lines in FIG. 3. However, when the glass pate 7 is placed in the flow-path of the alkali metal, the alkali metal can not be uniformly led to the photocathode 2. As a result, in the conventional photomultiplier, it is very difficult to form a uniform photosurface. In contrast, in the present embodiment, since such a glass plate 7 is not employed, the uniform photosurface can be produced readily.

In the present embodiment, there is no conventional grid electrode between the light entrance portion 15 and the photocathode 16, and the transparent conductive film 19, to which a predetermined potential is applied, formed on the light entrance portion 15 functions as a focusing electrode. Therefore, an electric field for focusing photoelectrons, formed between the photocathode 16 and the dynode 17*a* of the first stage of the electron multiplying unit 17, spreads up to the position near the inside wall surface of the light entrance portion 15 of the glass bulb 11. As a result, the photoelectrons, which are generated from the photocathode 16 and which exist in the vicinity of the photocathode 16, are guided due to the electric field for focusing and accelerated toward the dynode 17*a* of the first stage. Consequently, the photosensitivity of the photomultiplier according to the present embodiment is improved when compared with that of the photomultiplier shown in FIGS. 1 and 2 by 20% or more, and the SN ratio which is the ratio of the input signal to the noise is improved in the present embodiment.

In the present embodiment, since the predetermined potential is applied to the transparent conductive film 19 formed on the inside wall surface of the light entrance portion 15 of the glass bulb 11, the unstableness of the potential on the inside wall surface of the glass bulb 11 is eliminated. Therefore, even if the photoelectrons collide with the inside wall surface of the glass bulb 11, the potential of the inside wall surface of the glass bulb 11 immediately returns to the predetermined potential, that is, −1 KV, and hence the change of the potential of the inside wall surface of the glass bulb 11 is performed at high speed. It is considered that the photoelectrons from the photocathode 16 collide with the light entrance portion 15 of the glass bulb 11 and the portion is charged, whereby the potential of the portion becomes unstable and an electron track of photoelectrons is influenced. Therefore, the hysteresis of the photomultiplier becomes extremely small.

On the other hand, the conventional grid electrode 6 shown in FIGS. 1 and 2 plays not only a role as an electron lens but also a role for improving the hysteresis characteristic. Therefore, in the conventional grid electrode 6 shown in FIGS. 1 and 2, the photoelectrons moving from the photocathode 2 to the light entrance portion 5 are intercepted by stringing the conductive wire 6*c* on a plane in front of the entire front surface of the photocathode 2. However, some photoelectrons pass between the lattices of the grid electrode 6 and reach the light entrance portion 5, and hence the improvement of the hysteresis characteristic has a limitation. Further, in the conventional photomultiplier disclosed in JP-A-4-292843 in which the hysteresis characteristic is improved by forming the conductive portion on the inside wall surface of the glass bulb, there also arises the above-mentioned problem of the reduction in the transmittance since the grid electrode is placed in front of the photocathode. However, in the photomultiplier according to the present embodiment, as described above, the hysteresis of the photomultiplier is exceedingly small.

Figure 6:
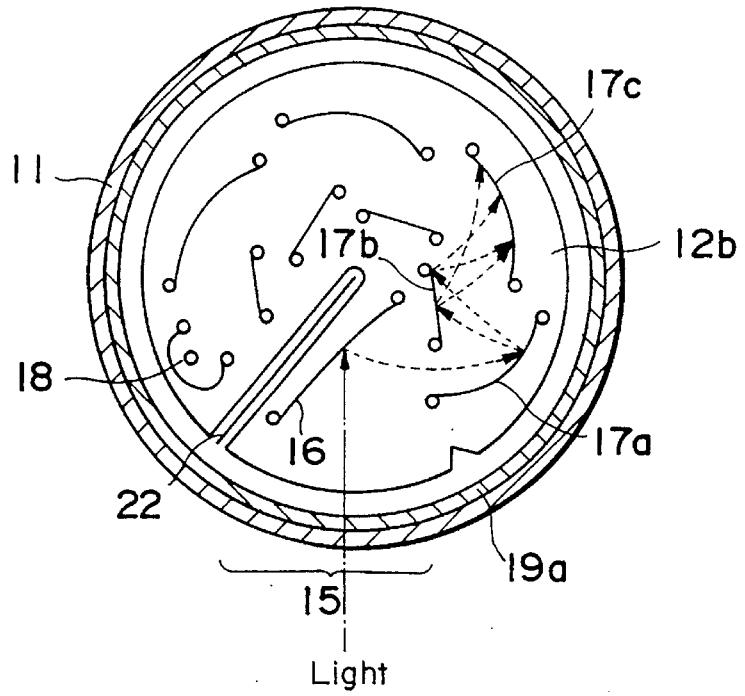
FIG. 6 is a cross-sectional view showing an example of a variant of a transparent conductive film in the first embodiment.

In the above explanation of the embodiment, the case where the transparent conductive film 19 is partly formed on the front of the light entrance portion 15 has been described. However, As shown in FIG. 6, a transparent conductive film 19*a* may be formed on the side portion, including the light entrance portion 15, of the glass bulb 11 along the perimeter of the glass bulb 11. However, a plate spring 41 (see FIG. 4) for fixing the insulating material substrate 12*a* to the glass bulb 11 is fixed to an end of a rod for supporting the dynode 17, and hence the plate spring 41 is electrically connected to the dynode 17. Therefore, the transparent conductive film 19*a* is not formed on the upper portion of the glass bulb 11 so that the transparent conductive film 19*a* does not contact with the plate spring 41. Even if the transparent conductive film 19*a* is employed, advantages similar to the above-mentioned embodiment are obtained. In FIG. 6, portions identical to those of FIGS. 4 and 5 are referred to by the same reference numerals, and therefore will not be described.

Next, a photomultiplier according to a second embodiment of the present invention will be described.

Figure 7:
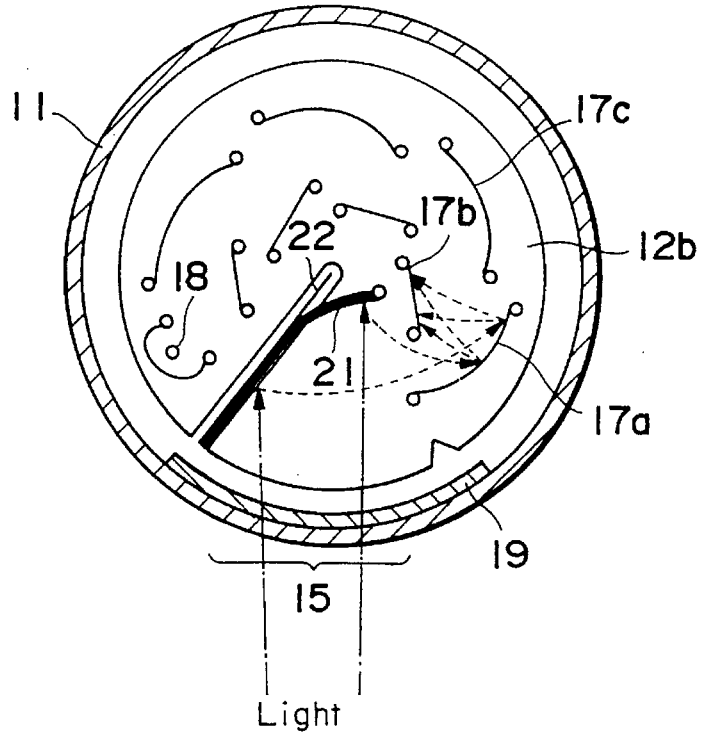
FIG. 7 is a cross-sectional view of a photomultiplier according to a second embodiment of the present invention.

FIG. 7 is a cross-sectional view of the photomultiplier according to the second embodiment. In FIG. 7, portions identical to those of FIGS. 4 and 5 are referred to by the same reference numerals, and therefore will not be described. The present embodiment differs from the first embodiment in a shape of a photocathode 21. That is, in the present embodiment, there is no rod on the light entrance portion 15 side of the photocathode 21, and an end of the light entrance side of the photocathode 21 is fixed to a shield plate 22 by weld. In this way, the photocathode 21 has a structure which functions also as a shield plate. Further, since there is no conventional grid electrode between the light entrance portion 15 and the photocathode 21, the photocathode 21 can be expanded to a portion interfered by the conventional grid electrode. That is, the end of the light entrance portion 15 of the photocathode 21 can be extended to a position extremely close to the inside wall surface of the glass bulb 11, so that the effective light-receptive area is increased. For example, in the present embodiment, the width of photocathode 21 in a direction perpendicular to the light entrance direction is about 3 mm wider than that of the photocathode 2 of the conventional photomultiplier shown in FIGS. 1 and 2. As a result, in the present embodiment, the photosensitivity of the photomultiplier is increasingly improved.

Figure 8:
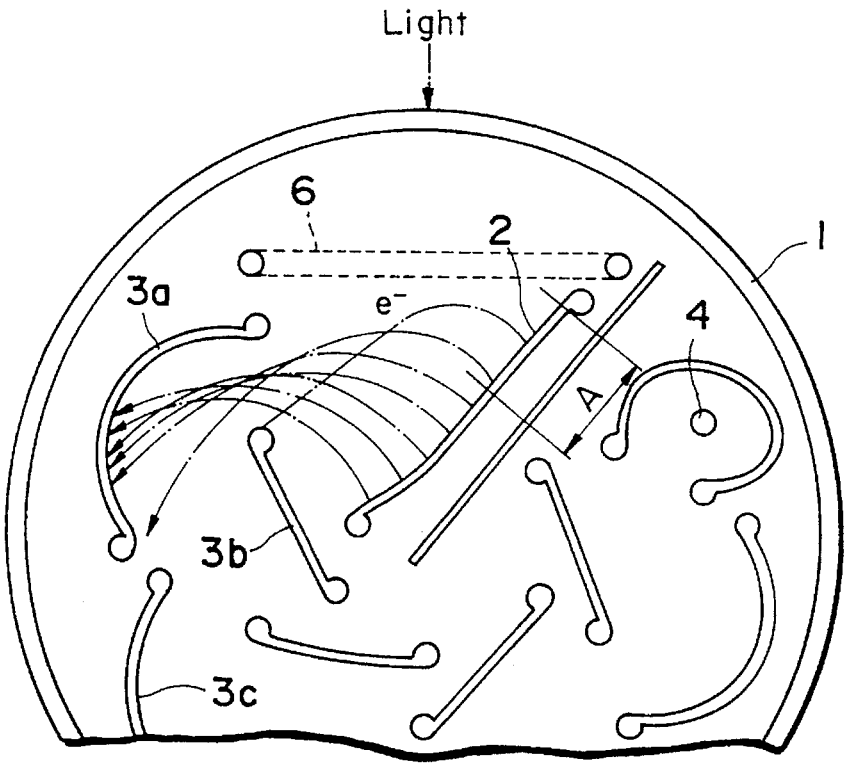
FIG. 8 is a diagram showing an electron track of photoelectrons in a conventional structure.
Figure 9:
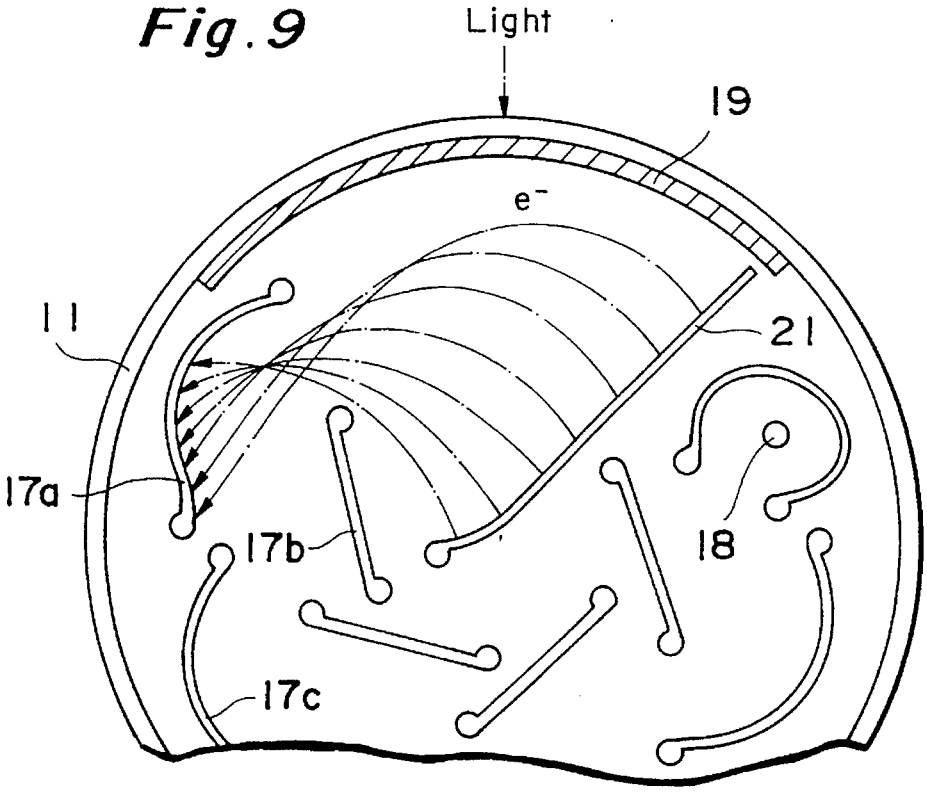
FIG. 9 is a diagram showing an electron track of photoelectrons in a structure according to the second embodiment.

Further, as is apparent from FIGS. 8 and 9, in the second embodiment, the electric field for focusing photoelectrons is extremely widespread. FIG. 8 shows the electric field for focusing which is formed in the conventional photomultiplier shown in FIGS. 1 and 2. In FIG. 8, portions identical or corresponding to those of FIGS. 1 and 2 are referred to by the same reference numerals, and therefore will not be described. FIG. 9 shows the electric field for focusing which is formed in the photomultiplier according to the second embodiment. In FIG. 9, portions identical or corresponding to those of FIG. 7 are referred to by the same reference numerals, and therefore will not be described.

In the conventional structure shown in FIG. 8, the electric field for focusing photoelectrons is formed by the photocathode 2, the grid electrode 6 and the dynodes 3*a* and 3*b*. Due to this electric field, an electron lens is formed between the photocathode 2 and the dynode 3*a*, thereby the photoelectrons trace the electron track shown in the figure. However, in this conventional structure, since there is the grid electrode 6 between the light entrance portion and the photocathode 2, the permeation of the electric field for focusing photoelectrons is weak in a region A of the photocathode 2 in the vicinity of the inside wall surface of the glass bulb 11. Therefore, the photoelectrons which exit in this region A among the photoelectrons emitted from the photocathode 2 is not efficiently guided to the dynode 3*a* of the first stage.

On the other hand, in the structure according to the present embodiment shown in FIG. 9, since there is no grid electrode such as the conventional grid electrode between the light entrance portion and the photocathode 21, as described above, the end of the photocathode 21 can be extended to the vicinity of the inside wall surface of the glass bulb 11 without being interfered by the grid electrode. Consequently, the electric field for focusing photoelectrons is formed to expand to the vicinity of the inside wall surface of the glass bulb 11, whereby the electric field sufficiently permeates also in the region in which the permeation of the electric field is conventionally weak so that the electron track shown in the figure is formed. As a result, most of the photoelectrons emitted from the photocathode 21 having the large size of the effective light-receiving area is efficiently guided to the dynode 17*a* of the fist stage, and therefore the photosensitivity of the photomultiplier is increasingly improved so that the SN ratio is extremely improved.

Next, a photomultiplier according to a third embodiment of the present invention will be described.

Figure 10:
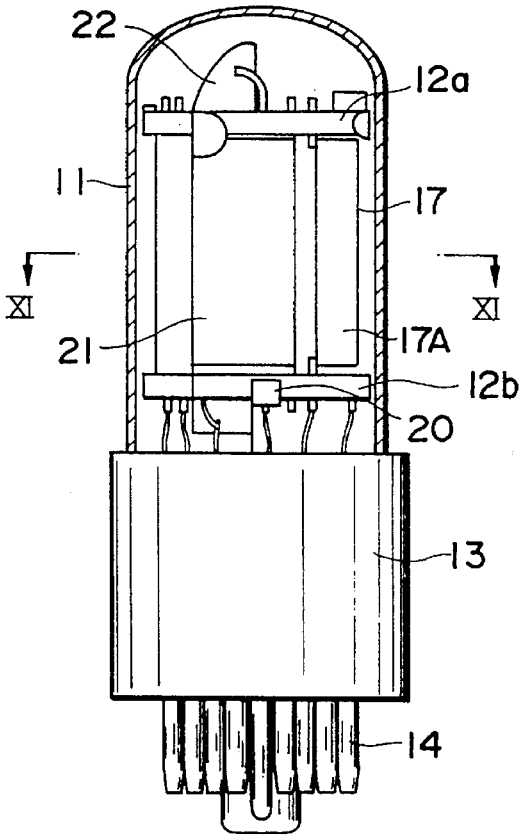
FIG. 10 is a side view, partly in vertical section, of a photomultiplier according to a third embodiment of the present invention.
Figure 11:
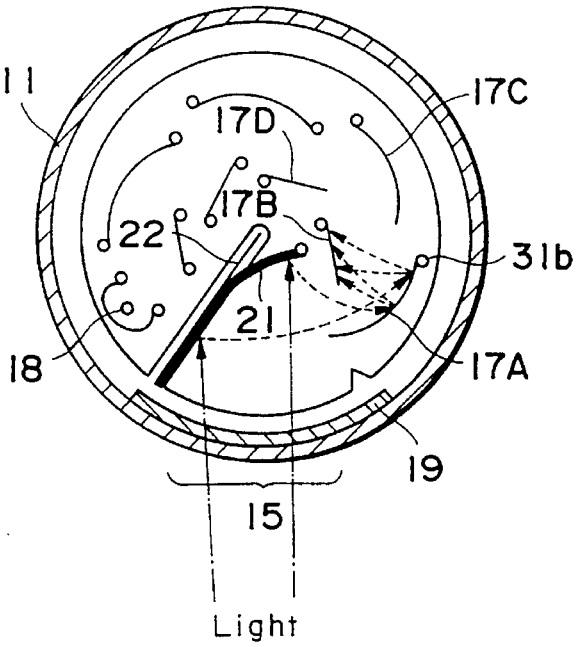
FIG. 11 is a cross-sectional view of the photomultiplier according to the third embodiment.
Figure 12:
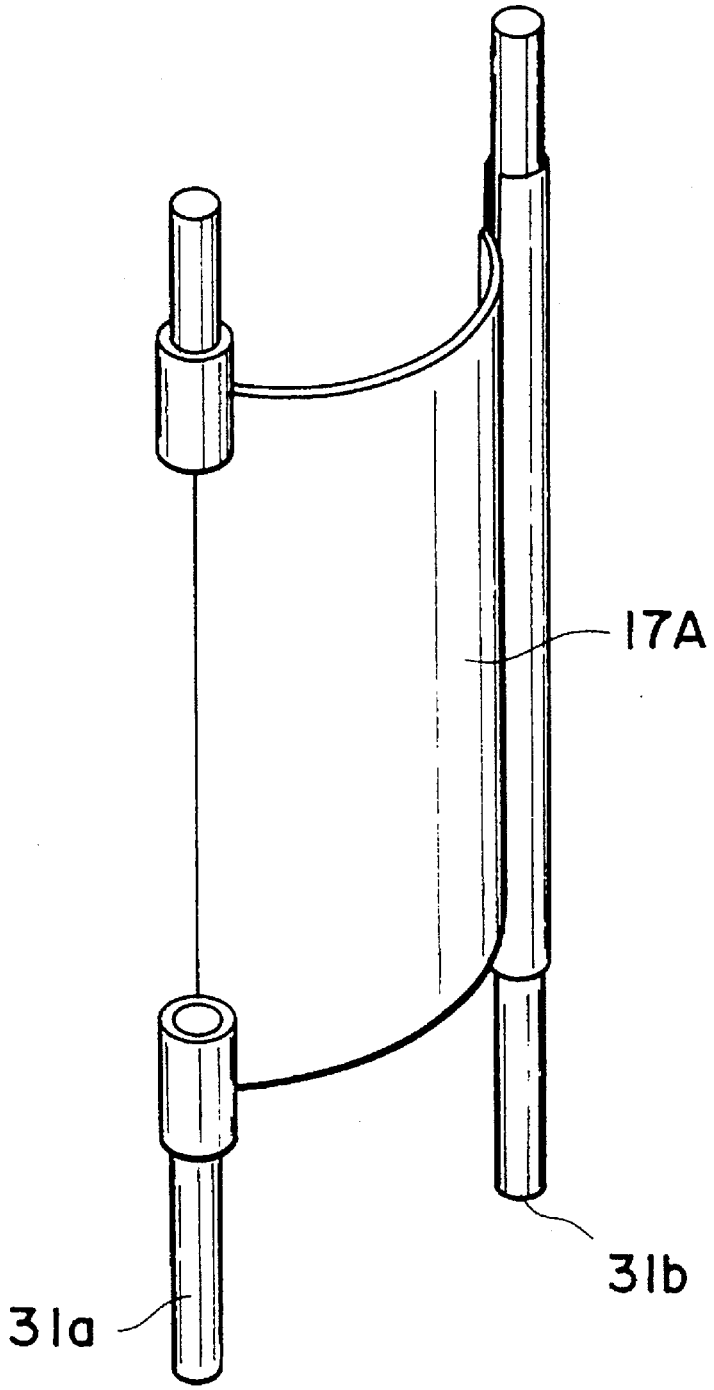
FIG. 12 is a perspective view showing a shape of a dynode in the third embodiment.

FIG. 10 is a side view, partly in vertical section, of the photomultiplier according to the third embodiment, and FIG. 11 is a cross-sectional view thereof. In FIGS. 10 and 11, portions identical or corresponding to those of FIGS. 4, 5 and 7 are referred to by the same reference numerals, and therefore will not described. The present embodiment differs from the second embodiment in the structure of the electron multiplying unit 17. That is, in each of dynodes 17A, 17B, 17C and 17D of fist, second, third and fourth stages constituting the electron multiplying unit 17, as shown in FIG. 12, the middle portion of a supporting rod 31*a* which exists at the light entrance side between two supporting rods 31*a* and 31*b* is eliminated. In FIG. 12, the dynode 17A is shown as a representative of these dynodes. Since the middle portion of the supporting rod 31*a* is eliminated in this way, it is prevented that the photoelectrons accelerated by the electric field for focusing is attracted by the supporting rod during the drift to bend the electron track like the conventional structure shown in FIG. 8. Therefore, the photoelectrons emitted from the photocathode 21 and the photoelectrons secondary-electron-multiplied in the dynodes of the respective stages surely reach the dynodes of the next stages, respectively. As a result, in the structure of the photomultiplier according to the present embodiment, the photosensitivity is increasingly improved.

Next, a photomultiplier according to a fourth embodiment of the present invention will be described.

Figure 13:
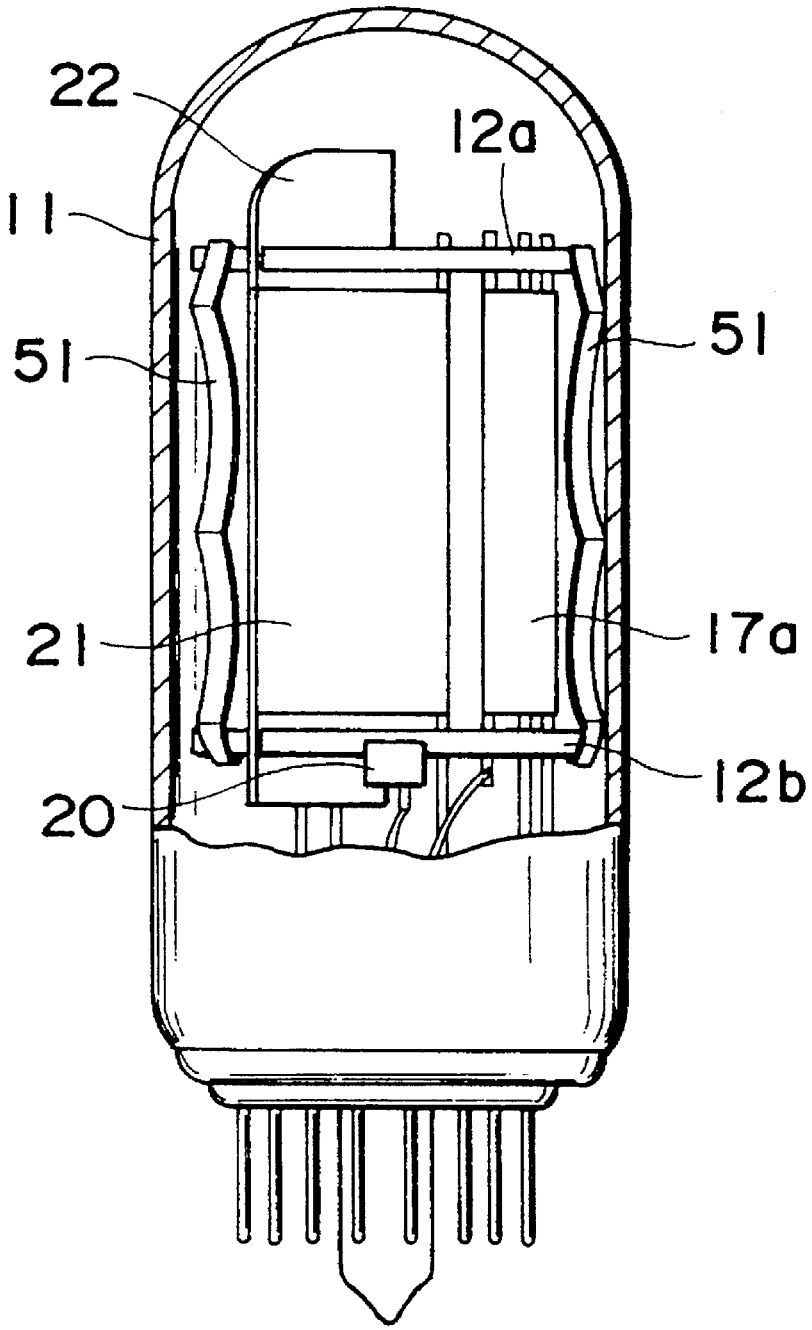
FIG. 13 is a side view, partly in vertical section, of a photomultiplier according to a fourth embodiment of the present invention.

FIG. 13 is a side view, partly in vertical section, of the photomultiplier according to the fourth embodiment. In FIG. 13, portions identical or corresponding to those of FIGS. 4, 5 and 7 are referred to by the same reference numerals, and therefore will not be described. The present embodiment differs from the above-mentioned second embodiment in a structure for fixing the insulating material substrates 12*a* and 12*b* supporting the photocathode 21 and dynodes 17 to the glass bulb 11. That is, in the structure shown in FIGS. 4 and 5, a part of the plate spring 41 having a shape extending along a direction of a circumference of the insulating material substrate 12*a* is fixed to an end of the supporting rods of the dynode 17. The plate spring 41 contacts with the inside wall of the glass bulb 11 at a plurality of positions. Due to the elastic force of the plate spring 41 toward the outside in a direction of a radius of the insulating material substrate 12*a*, the supporting rods of the dynode 17 and the insulating material substrate 12*a* fixed to the supporting rods are supported by and fixed to the inside wall of the glass bulb 11.

However, in the photomultiplier shown in FIG. 13 according to the present embodiment, a plurality of spring plates 51 is provided between the two insulating material substrates 12*a* and 12*b* at a plurality of positions. Two ends of each of the sprig plates 51 are engaged with the circumference portions of the insulating material substrates 12*a* and 12*b*, respectively. The middle portions of each of the spring plates 51 contact with the inside wall of the glass bulb 11. Due to the elastic force of each of the spring plates 51 toward the outside from the longitudinal center axis of the glass bulb 11, the insulating material substrates 12*a* and 12*b* are supported by and fixed to the inside wall of the glass bulb 11.

Figure 14:
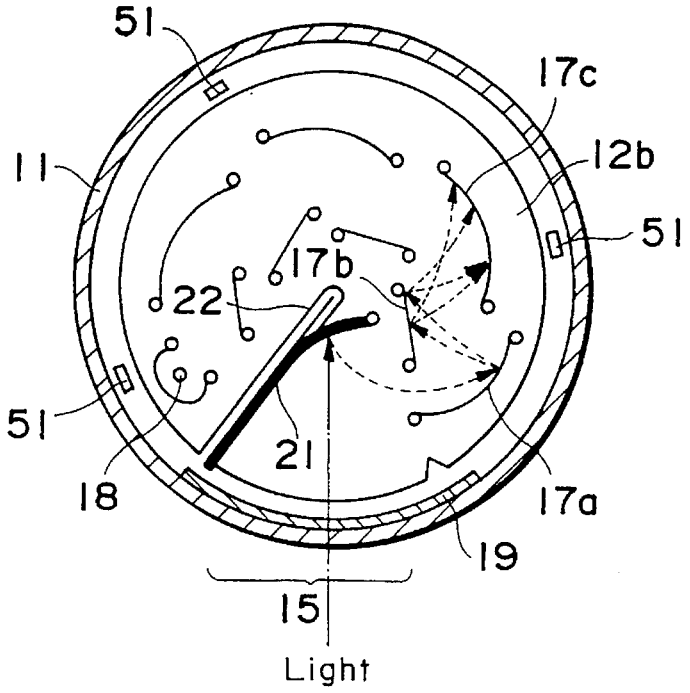
FIG. 14 is a cross-sectional view showing an example of a structure of a transparent conductive film in the fourth embodiment.
Figure 15:
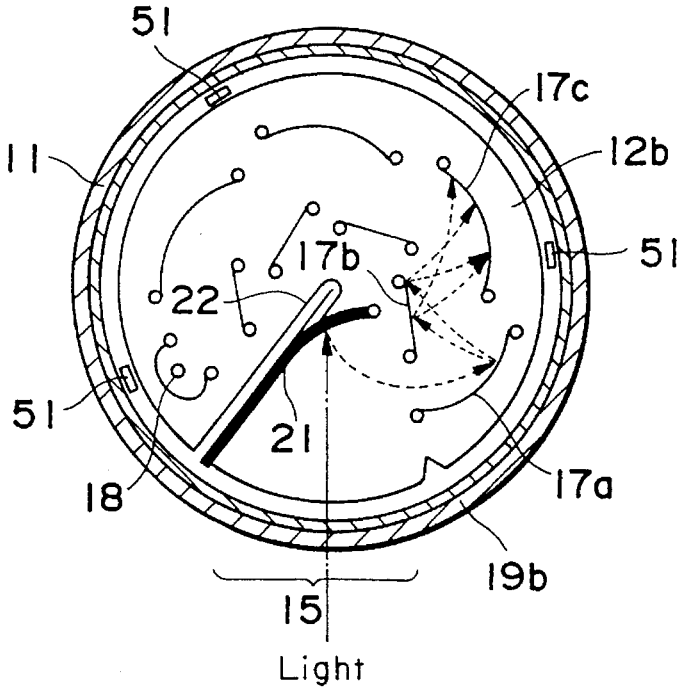
FIG. 15 is a cross-sectional view showing another example of a structure of the transparent conductive film in the fourth embodiment.

Since the spring plates 51 electrically float, in the present embodiment, even if the transparent conductive film constituting the electrode for focusing contacts electrically with the spring plates 51, the electron multiplying function is not influenced. That is, in the present embodiment, the transparent conductive film 19 may be partly formed on only the place corresponding to the light entrance portion 15 as shown in FIG. 14 in a manner similar to the second embodiment, and the transparent conductive film 19*b* may be formed on the whole of the inside wall surface of the glass bulb 11 as shown in FIG. 15. In FIGS. 14 and 15, portions identical or corresponding to those of FIG. 7 are referred to by the same reference numerals, and therefore will not be described. When the transparent conductive film 19*b* is formed on the whole of the inside wall surface as shown in FIG. 15, the manufacturing process in which the transparent conductive film is selectively formed on only the place corresponding to the light entrance portion 15 is eliminated. Therefore, according to the photomultiplier having the structure shown in FIG. 15, an advantage that the manufacturing process is simplified is obtained in addition to advantages similar to the above-mentioned second embodiment.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

The basic Japanese Application No.309371/1993 filed on Dec. 9, 1993 is hereby incorporated by reference.

What is claimed is:

1. A photomultiplier comprising:

a transparent closed container including a light entrance portion;

a reflection type photocathode, provided in said closed container, for emitting photoelectrons in response to an incident light transmitted through said light entrance portion;

a transparent conductive film formed on an inside wall surface of said light entrance portion of said closed container, a predetermined potential being applied to said film;

an electron multiplying unit, including plural stages of dynodes, for electron-multiplying said photoelectrons emitted from said reflection type photocathode; and an anode for collecting said multiplied electrons.

2. A photomultiplier according to claim 1, wherein said transparent conductive film is formed in a manner that chromium is evaporated onto said inside wall surface of said closed container.

3. A photomultiplier according to claim 1, further comprising:

a pad adhered to said inside wall surface of said closed container so as to electrically contact with said transparent conductive film; and a terminal electrically contacting with said pad, a part of said terminal being exposed to an outside of said closed container;

wherein said predetermined potential is applied through said pad and said terminal to said transparent conductive film.

4. A photomultiplier according to claim 1, wherein the same negative-polarity potential is applied to said photocathode and said transparent conductive film, a ground potential is applied to said anode, and an appropriate potential which divides a voltage between said negative-polarity potential and said ground potential is applied to each of said dynodes, respectively.

5. A photomultiplier according to claim 1, further comprising a shield plate provided at the rear of said photocathode, wherein an end of a light entrance side of said photocathode is fixed to an end of a light entrance side of said shield plate.

6. A photomultiplier according to claim 1, further comprising:

a pair of insulating material substrates for supporting said photocathode, said electron multiplying unit and said anode; and a plate spring having a shape extending along a direction of a circumference of said insulating material substrate, a part of said plate spring being fixed to an end of a supporting rod of said dynode constituting said electron multiplying unit, a part of said plate spring contacting with said inside wall of said closed container;

wherein said supporting rod and said insulating material substrate fixed to the supporting rod are supported by and fixed to said inside wall of said closed container, due to an elastic force of said plate spring toward an outside of said closed container in a direction of a radius of said insulating material substrate.

7. A photomultiplier according to claim 6, wherein said transparent conductive film is formed on a side wall of an inside of said closed wall at a area in which said transparent conductive film does not electrically contact with said plate spring, said area including said place corresponding to said light entrance portion.

8. A photomultiplier according to claim 1, further comprising:

a pair of insulating material substrates for supporting said photocathode, said electron multiplying unit and said anode; and a spring plate of which two ends are engaged with said insulating material substrates, respectively, a middle portion of said spring plate contacting with said inside wall of said closed container;

wherein said insulating material substrates are supported by and fixed to said inside wall of said closed container, due to an elastic force of said spring plate toward an outside of said closed container from a longitudinal center axis of said closed container.

9. A photomultiplier according to claim 8, wherein said transparent conductive film is formed on the whole of said inside wall surface of said closed container.

10. A photomultiplier, comprising:

a transparent closed container including a light entrance portion;

a reflection type photocathode, provided in said closed container, for emitting photoelectrons in response to an incident light transmitted through said light entrance portion;

an electron multiplying unit, including plural stages of dynodes, for electron-multiplying said photoelectrons emitted from said reflection type photocathode;

an anode for collecting said multiplied electrons; and a pair of insulating material substrates for supporting said photocathode, said electron multiplying unit and said anode;

wherein one supporting rod of a pair of supporting rods for supporting said dynodes of said electron multiplying unit has first and second portions which are separated from each other, and portions of one of said dynodes are at least partially wound around said first and second portions of said one supporting rod.

11. A photomultiplier according to claim 10, wherein said one of said dynodes is at least the dynode of a first stage into which said photoelectrons emitted from said photocathode enters directly.

* * * * *